US005545795A

United States Patent [19]

Hanulik

[11] Patent Number: 5,545,795

[45] **Date of Patent: *Aug. 13, 1996**

[54] METHOD FOR DECONTAMINATING RADIOACTIVE METAL SURFACES

[75] Inventor: Jozef Hanulik, Zürich, Switzerland

[73] Assignee: Deco-Hanulik AG, Switzerland

[ * ] Notice: The term of this patent shall not extend beyond the expiration date of Pat. No. 5,386,078.

[21] Appl. No.: 284,166

[22] Filed: Aug. 2, 1994

Related U.S. Application Data

[63] Continuation-in-part of Ser. No. 188,250, Jan. 28, 1994, Pat. No. 5,386,078.

[51] Int. Cl.[6] ..... G21F 9/00

[52] U.S. Cl. ..... 588/2; 134/3; 134/10; 134/22.18; 134/41; 976/DIG. 376

[58] Field of Search ..... 588/18, 2, 1; 134/3, 134/10, 22.18, 41; 976/DIG. 376

[56] References Cited

U.S. PATENT DOCUMENTS 4,508,641 4/1985 Hanulik ..... 588/3

5,008,044 4/1991 Hanulik ..... 588/3

5,386,078 1/1995 Hanulik ..... 588/18

*Primary Examiner*—Ngoclan Mai

*Attorney, Agent, or Firm*—Speckman, Pauley & Fejer

[57] ABSTRACT

A method to decontaminate radioactively contaminated metallic objects in which the objects are contacted with a non- radioactive, aqueous solution containing acetic acid. The metallic objects are in contact with the acid continuously or successively over several hours until the acid is completely stoichiometrically depleted. The concentration of the aqueous solution containing acetic acid is preferably approximately 0.3 Mol/l. These steps are repeated until the residual contamination of the metallic objects is beneath the desired target threshold of 0.37 Bq/cm$^2$. The radioactive metallic oxides and metallic hydroxides in the aqueous stoichiometrically depleted solution are sedimented out, and the sludge is solidified with cement and subsequently decontaminated.

12 Claims, No Drawings

METHOD FOR DECONTAMINATING RADIOACTIVE METAL SURFACES

CROSS-REFERENCE TO RELATED APPLICATION

This is a continuation-in-part patent application of U.S. patent application having Ser. No. 08/188,250, filed 28 Jan. 1994, now U.S. Pat. No. 5,386,078.

BACKGROUND OF THE INVENTION

1. Field of the Invention

This invention relates to a method for decontaminating radioactive metal surfaces with an aqueous solution containing acetic acid.

2. Description of Prior Art

Several different methods are known for decontaminating radioactive metal surfaces. The use of fluoroboric acid to decontaminate radioactively contaminated surfaces is taught by U.S. Pat. No. 5,008,044. The method taught by the '044 patent is suited for decontamination of surfaces comprising metallic as well as mineral substances. The advantage of the method taught by the '044 patent is the high absorbency of the decontamination agent used, which provides a great stripping depth, making the method particularly suitable for cleaning medium and severely radioactively contaminated items of various materials. Appropriately, the method taught by the '044 patent is also used in decontamination efforts at Chernobyl, Russia. The high metallic content permits electrolytic regeneration of the metals. Decontamination of tanks is costly, however, and produces a large amount of waste because of the acid residue present. The toxicity of the decontamination agent poses an additional problem, particularly at higher temperatures, such as above 130° C., when the decontamination agent pyrolizes into toxic borofluoride.

Another decontamination method, taught by U.S. Pat. No. 4,508,641, uses formic acid and/or acetic acid as a decontamination agent and at least one reducing agent, such as formaldehyde and/or acetaldehyde. The '641 patent teaches a method for decontaminating reactor cooling coils, with which steel surfaces can be cleaned with relatively small quantities of chemicals and rinsing water, and wherein used decontamination solution is reprocessed. The addition of reducing agents causes the iron ions to remain stable in the solution, prohibiting the formation of compounds. In a system with closed loops, prohibiting the formation of compounds is crucial for preventing the formation of sediment from settling compounds. The iron compounds are only separated from the decontamination solution in a second step of the decontamination method taught by the '641 patent. Because the entire decontamination process takes place in a closed loop, either the decontamination agent must be continuously injected because it is stoichiometrically depleted, or high concentrations of the acids must be used. On the other hand, the decontamination of a tank does not present such problems. However, cleaning and decontaminating the entire cooling medium in a closed loop according to the decontamination method of the '641 patent is extremely problematic because of the formaldehyde that is present as a reducing agent. A complete decontamination below the permissible threshold of 0.37 Bq/cm, for example, is hardly possible. Nevertheless such complete decontamination of the entire cooling medium is not required inside the cooling loops of reactors.

SUMMARY OF THE INVENTION

It is an object of this invention to provide a decontamination method which uses a decontamination agent that is low in toxicity, a decontamination method which is economical, and a decontamination method which produces relatively little secondary waste.

This and other objects are achieved by a decontamination method according to this invention in which a radioactively contaminated metallic object is contacted with a substantially non-radioactive, aqueous solution containing 0.05% to 5.0% volume acetic acid, preferably by immersion in said aqueous solution, until the acetic acid in the aqueous solution in contact with the metallic object is nearly completely stoichiometrically depleted, thereby forming an aqueous, stoichiometrically depleted solution. As used in this application, the term "non-radioactive" is intended to relate to an aqueous solution that is either completely free of radioactivity or has a very insignificant level of radioactivity.

In one preferred decontamination method according to this invention, the radioactively contaminated object is again contacted with the acetic acid-containing aqueous solution until the acetic acid in the aqueous solution is nearly completely stoichiometrically depleted and this step is repeated until the radioactively contaminated metallic object has a residual radioactivity level below a permissible threshold level. Radioactively charged metallic oxides and metallic hydroxides are precipitated out from the aqueous stoichiometrically depleted solutions, forming a radioactive sediment. The radioactive sediment is solidified and separated from the aqueous, stoichiometrically depleted solution. The aqueous, stoichiometrically depleted solution may then be regenerated by adding acetic acid for additional decontamination of other radioactively contaminated metallic objects.

A method of this type has the advantage that the solution need not be completely cleaned after each use. As a result, the level of secondary waste is relatively small. Only after the decontamination effort has been completed is the remaining aqueous solution completely cleaned with known agents.

In a decontamination method according to this invention where the radioactively contaminated metallic objects comprise aluminum, lead, copper or nickel or alloys containing aluminum, lead, copper or nickel, an oxidizing agent, preferably hydrogen peroxide, is added to the aqueous solution containing acetic acid.

DESCRIPTION OF PREFERRED EMBODIMENTS

Laboratory tests which illustrate the decontamination method of this invention are described in detail below. A radioactively contaminated metallic object weighing approximately 200 kg, which in this laboratory test was a crane hook, was placed into an empty polypropylene tank with a capacity of approximately 300 l. The entire metal surface area of the crane hook was estimated to be approximately 2 $m^2$. In a second step, 150 l of a 0.5% formic acid decontamination solution or agent was added to the bath. In a third step, the crane hook was left in the bath at an ambient temperature for 5 to 16 hours. Subsequently, the stoichiometrically depleted decontamination solution was pumped out. At this point the radioactivity of the used decontamination agent and the remaining radioactivity of the metallic object was measured, and the foregoing steps were repeated. These steps had to be repeated numerous times, depending on the extent of the radioactive contamination. After it was determined that the residual radioactivity of the crane hook was below the permissible threshold, the used decontamination agent was electrolytically treated in the same bath. The remaining sludge, comprising predominantly Fe, Fe $(OH)_x$, and other impurities, including the absorbed radioactivity, were solidified with cement after sedimentation and sanitized. In a final step, remaining water was then passed through an ion exchanger and subsequently delivered to a sewage treatment plant.

In other laboratory tests, the time required for stripping a radioactive layer of metal from a sample of A43 steel was determined. The tests were performed on a sample weighing 200 g and having the dimensions of 50×100×5 mm. From these laboratory tests it was determined that with a decontamination solution having a very low formic acid concentration, such as 0.3 Mol/l, metallic stripping could be very precisely controlled by altering the bath temperature. Thus, it was determined, for example, that with a bath temperature of 19° C. the stripping rate was 1.1 $mg/cm^2 \cdot hr$, while a bath temperature of 80° C. produced a stripping rate of 35 $mg/cm^2 \cdot hr$. As in the laboratory test previously discussed, the used radioactively contaminated solution was subjected to anodic oxidation by means of electrolysis. The iron hydroxide sludge formed in this laboratory test absorbed the radioactivity. After sedimentation, the remaining water was used for further decontamination.

A quantitative comparison between the method taught by U.S. Pat. No. 4,508,641 and a decontamination method according to this invention reveals that a decontamination method according to this invention produces 30 times less secondary waste than the method taught by the '641 patent. This comparison clearly shows the economic significance of the method of this invention.

Although the examples cited herein utilize formic acid, the method of this invention can be performed absolutely identically using acetic acid instead of formic acid, as described, without changes regarding concentration or temperature. The two low-molecular carboxylic acids, formic acid and acetic acid, are the only carboxylic acids which are usable for this purpose. All higher-molecular carboxylic acids form complex byproducts which cause an increase in secondary waste.

In the examples described hereinabove, contacting of the radioactive surfaces was performed by dipping the radioactively contaminated metallic object into a bath. Another form of contacting of the acid-containing aqueous solution with the radioactive surface comprises spreading the metallic objects to be decontaminated on a surface and drizzling or spraying the objects with the acid-containing aqueous solution. The acid-containing aqueous solution contacting the surface to be decontaminated is substantially stoichiometrically depleted of acid in the contact area. After a short reaction time, it is then possible to wash down the metallic surface with a stream of increased pressure. In the process, the substantially stoichiometrically depleted acid-containing aqueous solution is washed away, together with reaction products possibly formed on the metallic surface. Thereafter the metallic surface to be decontaminated can again be sprayed or drizzled. This treatment at intervals completely corresponds to a sequence of baths. Only a mechanical surface cleaning is performed by the spraying between two spraying or drizzling operations. This mechanical cleaning could also be achieved by brushes.

The alternating drizzling and washing operations can be performed with the same acid-containing aqueous solution, which is always almost completely stoichiometrically depleted of acid in the contact area. This can be done until the entire amount of the acid-containing aqueous solution has been nearly totally stoichiometrically used up.

It is preferred, in this method, that washing off the surface of the object with water is the last step. This method is usable for all mentioned metals or for alloys containing such metals.

Tests of radioactive lead plates in particular have shown that this method is extremely simple and quick. The following qualitative conversion takes place during the process of this invention:

$$Pb+2\ CH_3COOH+H_2O_2 \rightarrow Pb\ (CH_3COOH)_2+H_2O+PB\ \text{oxides}$$

A dark coating formed on the lead plates by this process is simply washed off by spraying. The stoichiometrically depleted solution is regenerated by separating off a sludge of Pb oxides by sedimentation, which solidifies and is processed as radioactive waste. The remaining solution is electrolytically treated in accordance with the following reactions:

Reaction at the cathode:

$$Pb^{2+}+2e^- \rightarrow Pb^o\ \text{Lead precipitation}$$

Reaction at the anode:

$$COOH^-+H^+ \rightarrow HCOOH\ \text{Acid regeneration}$$

$$Pb^{2+}+O_2^{2-} \rightarrow PbO_2\ \text{Lead oxide formation}$$

The lead precipitation products as well as the lead oxide are radioactive and are solidified with sludge and disposed of. The regenerated acid is radiation-free and suitable for reuse. It is only necessary to set the concentration again.

I claim:

1. In a method for decontaminating radioactive metal surfaces with an aqueous solution containing acetic acid, the improvement comprising: contacting a radioactively contaminated metallic object with an aqueous solution comprising 0.05%–5.0% volume acetic acid until the acetic acid in contact with said radioactively contaminated metallic object is nearly completely stoichiometrically depleted thereby forming an aqueous, stoichiometrically depleted solution comprising radioactively charged metallic oxides and metallic hydroxides; repeating the contacting of the metallic object with an additional amount of the aqueous solution until the radioactively contaminated metallic object has a residual radioactivity level below a permissible threshold level; sedimenting out said radioactively charged metallic oxides and metallic hydroxides from the aqueous, stoichiometrically depleted solution, forming a radioactive sediment; separating the aqueous, stoichiometrically depleted solution from the radioactive sediment; and solidifying the radioactive sediment.

2. In a method according to claim 1, wherein the separated aqueous, stoichiometrically depleted solution is purified with a resin ion exchanger to form deionized water.

3. In a method according to claim 1, wherein the aqueous, stoichiometrically depleted solution is electrolytically treated.

4. In a method according to claim 1, wherein the radioactively contaminated metallic object comprises at least one of a metal and a metal alloy selected from the group consisting of aluminum, lead, copper, nickel, and mixtures thereof and an oxidizing agent is added to the aqueous solution.

5. In a method according to claim 4, wherein the oxidizing agent is hydrogen peroxide.

6. In a method according to claim 1, wherein the aqueous solution is maintained at a temperature between about ambient temperature and about 80° C.

7. In a method according to claim 1, wherein the concentration of the acetic acid in the aqueous solution is 0.1 to 1.0 Mol/l, and a stripping rate is controlled by a temperature of the aqueous solution.

8. In a method according to claim 1, wherein contacting of the radioactively contaminated metallic objects is accomplished by dipping into a bath.

9. In a method according to claim 1, wherein contacting of the radioactively contaminated metallic object is accomplished by drizzling the aqueous solution on the metal surfaces.

10. In a method according to claim 9, wherein a mechanical surface cleaning of said metal surfaces is performed following drizzling of the aqueous solution.

11. In a method according to claim 9, wherein a phase of spraying off under increased pressure follows each drizzling phase, all phases of spraying off being performed with the aqueous solution until the desired degree of radioactive decontamination has been achieved whereupon a final spraying off with water is performed.

12. In a method for decontaminating radioactive metal surfaces with an aqueous solution containing acetic acid, the improvement comprising: contacting a radioactively contaminated metallic object with an aqueous solution consisting essentially of 0.05%–5.0% volume acetic acid and an oxidizing agent until the acetic acid is nearly completely stoichiometrically depleted thereby forming an aqueous, stoichiometrically depleted solution comprising radioactively charged metallic oxides and metallic hydroxides; repeating the contacting of the metallic object with an additional amount of the aqueous solution until the radioactively contaminated metallic object has a residual radioactivity level below a permissible threshold level; sedimenting out said radioactively charged metallic oxides and metallic hydroxides from the aqueous, stoichiometrically depleted solution, forming a radioactive sediment; separating the aqueous, stoichiometrically depleted solution from the radioactive sediment; and solidifying the radioactive sediment.

* * * * *